US007743854B2

(12) United States Patent
Khomynets

(10) Patent No.: US 7,743,854 B2
(45) **Date of Patent: *Jun. 29, 2010**

(54) WELL JET DEVICE AND THE OPERATING METHOD THEREOF

(76) Inventor: Zinoviy Dmitrievich Khomynets, kv.4, d.46. Zeleny pr-t, Moscow (RU) 111396

( * ) Notice: Subject to any disclaimer, the term of this patent is extended or adjusted under 35 U.S.C. 154(b) by 1 day.

This patent is subject to a terminal disclaimer.

(21) Appl. No.: 12/279,822

(22) PCT Filed: Nov. 28, 2006

(86) PCT No.: PCT/RU2006/000632

§ 371 (c)(1),
(2), (4) Date: Aug. 18, 2008

(87) PCT Pub. No.: WO2007/108716

PCT Pub. Date: Sep. 27, 2007

(65) Prior Publication Data

US 2008/0314595 A1 Dec. 25, 2008

(30) Foreign Application Priority Data

Mar. 22, 2006 (RU) ..... 2006108887

(51) Int. Cl.
*E21B 43/12* (2006.01)

(52) U.S. Cl. ..... 175/372; 417/172

(58) Field of Classification Search ..... 166/369, 166/374, 321, 372; 417/172
See application file for complete search history.

(56) References Cited

U.S. PATENT DOCUMENTS

2004/0071557 A1* 4/2004 Khomynets ..... 417/172
2009/0016900 A1* 1/2009 Khomynets ..... 417/172

FOREIGN PATENT DOCUMENTS

GB 2410044 A 7/2005
RU 2059891 C1 5/1996
RU 2246049 C1 2/2005

* cited by examiner

*Primary Examiner*—William P Neuder
(74) *Attorney, Agent, or Firm*—patenttm.us

(57) ABSTRACT

The device comprises a body provided with bypass ports embodied therein and an insert with a jet pump and sealing elements. The insert comprises a pass channel, a channel for supplying an active medium to the pump nozzle, a channel which is used for supplying a pumped-out medium to the pump and which communicates with the pass channel and an output channel connected to an annular space. A mounting seat for a sealing unit is embodied in the pass channel above the channel for supplying the pumped-out medium. Said mounting seat is provided with an axial channel for passing a cable, which is used for moving instruments along the well bore, therethrough and through the pass channel. An axially movable spring-loaded steady bush provided with bypass holes in the wall thereof is arranged in the body. The insert provided with the pump is placed on the mounting seat embodied in the bush. An annular recess limiting the bush displacement is embodied in the body. The output channel is connected to a body surrounding space when the bush is in the lower position thereof and the bypass ports are closed by the steady bush wall when the bush is in the top position. Said invention makes it possible to reduce a time for a well examination and development.

5 Claims, 3 Drawing Sheets

WELL JET DEVICE AND THE OPERATING METHOD THEREOF

FIELD OF THE INVENTION

This invention relates to pumping equipment, primarily to well jet devices for testing oil and gas wells and to an operating method thereof

PRIOR ART

A well jet device is known, which comprises a jet pump installed on a flow string and a geophysical instrument arranged below the said jet pump in the said flow string (RU 2059891 C1).

The same patent document teaches a method of operating a well jet device, comprising feeding an active medium along a pipe string to the nozzle of a jet pump, which medium, while exiting, draws a pumped liquid medium to a mixing chamber, medium mixture is fed from the mixing chamber to a diffuser where the flow kinematic energy is partially transformed to potential energy, and the medium mixture is fed from the diffuser along the pipe string annular space to a consumer; physical parameters of the pumped out medium and the producing formation (i.e., pressure, density, gas saturation, solid-phase content, temperature, flow velocity, flow rate, etc.) are measured with the use of a instrumentation unit comprising emitters and detectors-transducers of physical fields, measurements being transferred by a cable to the surface; required measurements are taken and an optimal operating mode for the jet pump is selected by changing the active medium flow rate and pressure; and, when necessary, the pumped-out medium and the producing formation are treated (by heating, ultrasonic crushing of the mud, etc.) with the use of physical field emitters.

The above device and the method of operating thereof enable to pump a variety of produced media, e.g., oil, out of a well, and simultaneously treat and study both a produced medium and the near-wellbore area of the formation.

However, this device does not provide for operative replacement of the nozzle without lifting the flow string to the surface.

The closest to this invention as to the technical essence and the achieved result is a well jet device comprising a body with bypass ports and an insert with a jet pump, said insert having a pass-through channel, a channel for supplying an active medium to the jet pump nozzle, a channel for supplying a pumped-out medium to the jet pump, this channel being in communication with the pass-through channel, and an output channel, a mounting seat for a sealing unit being made above the channel for supplying a pumped-out medium in the pass-through channel, the mounting seat being provided with an axial channel for passing a cable or a wire through it and through the channel for supplying a pumped-out medium for the purpose of attaching wellbore instruments and equipment thereto below the jet pump in the wellbore with the possibility of moving them along the wellbore when the jet pump is or is not in operation, the output channel being in communication with the body inner cavity above the jet pump, and the insert being provided with sealing elements (US 2004/0071557 A1).

The same patent also teaches a method of operating the well jet device, which comprises lowering a pipe string with a packer and the body in a well, arranging the packer over a producing formation, bringing the packer into the working position, thus separating the wellbore annular space around the pipe string, lowering an insert with a jet pump and a sealing unit as well as instruments and equipment on a cable into the pipe string, fixing the insert with the jet pump in the body by a fixing mechanism, pumping an active medium into the wellbore space around the pipe string, which medium, while exiting the pump nozzle, is formed into a stable jet drawing a surrounding medium into the jet pump, which results in pressure reduction first in the channel for supplying a pumped-out medium and then in the under-packer space of the wellbore, thus creating pressure drawdown on the producing formation, then a medium mixture comes from the well to the surface along the pipe string due to the working medium energy, parameters of the pumped-out medium being monitored during pumping out the formation fluid with the use of the instruments and equipment that are arranged on the cable, while acting on the producing formation with physical fields.

The above well jet device and the method of operating it enable to conduct various technological operations in a wellbore below the level at which the jet pump is arranged, including those involving reducing pressure differential above and under the sealing unit.

However, this device does not enable to utilize its capabilities in full due to the fact that its design capabilities are insufficient for studying producing formations in a well and when pumping acid solutions or hydrofracturing fluids into a formation.

SUMMARY OF THE INVENTION

The objective of this invention is to expand technological capabilities of a well jet device for using it when carrying out various studies and other operations in wells.

The technical effect achieved after implementation of the invention is lessened times of studies, repairs and development of wells as well as improvement in reliability of information on physical properties of producing formations.

The stated objective in respect of the device is solved and the stated technical effect is achieved due to that the well jet device comprises a body with bypass ports and an insert with a jet pump, the insert having a pass-through channel, a channel for supplying an active medium into the jet pump nozzle, a channel for supplying a pumped-out medium to the jet pump which is in communication with the pass-through channel, and an output channel, a mounting seat being made in the pass-through channel above the channel for supplying a pumped-out medium, a sealing unit being installed on the mounting seat, and an axial channel being made in the sealing unit for passing a cable or a wire through it and the pass-through channel for the purpose of installing on said cable or wire below the jet pump in a well downhole instruments and equipment with the possibility of moving them along the wellbore when the jet pump is or is not operated; the output channel is in communication with the well annular space, and sealing elements are installed on the insert, an axially movable bearing sleeve, which is spring-loaded against the body, is installed in the body, and the insert with the jet pump is arranged on the mounting seat made in the bearing sleeve, said bearing sleeve being provided with bypass openings made in its wall, an annular recess being made in the body, which limits by its ends movement of the bearing sleeve, and, when the bearing sleeve is in its lower position, the output channel is in communication through the bypass openings and the bypass ports, and, when the bearing sleeve is in its upper position, the body bypass ports are closed by the wall of the bearing sleeve.

The stated objective in respect of the device is solved and the technical effect is achieved also due to that additional sealing elements may be installed on the bearing sleeve both above and below the bypass openings.

The stated objective in respect of the method is solved and the technical effect is achieved due to that the method of operating the well jet device comprises lowering the body provided with bypass ports and with a spring-loaded bearing sleeve having bypass openings, the body bypass ports being closed by the wall of the bearing sleeve which is in its upper position under the action of the spring, lowering an insert with a jet pump into a well on a cable or a wire, said cable or wire being preliminarily passed through the axial channel of the sealing unit as well as through the pass-through channel of the insert, installing the sealing unit on the mounting seat in the pass-through channel, attaching downhole instruments and equipment, e.g., a well-logging instrument for registration of a formation fluid inflow profile, to the lower end of the cable or the wire, installing the insert together with the jet pump and the sealing unit on the mounting seat of the bearing sleeve, and arranging downhole instruments and equipment with the use of the cable or the wire at a pre-defined depth in the well below the body, supplying a pressurized active medium, e.g., water, a salt solution or oil, along the pipe string, thus moving the spring-loaded bearing sleeve together with the insert and the jet pump to the lowermost position for aligning the bearing sleeve bypass openings with the body bypass ports, and supplying an active medium through the channel for supplying an active medium to the jet pump nozzle, which medium, while exiting the nozzle, forms a stable jet causing pressure reduction first in the channel for supplying a pumped-out medium and then also in the inner cavity of the pipe string below the jet pump body, thus creating a pressure drawdown on a producing formation in the well and drawing a formation fluid, as pumped out of the well, into the jet pump, monitoring, while pumping out a formation fluid, parameters of the pumped-out formation fluid and physical parameters of the producing formation along the well bore with the use of the downhole instruments and equipment installed on the cable or the wire, as well as perforating formations in the pressure drawdown mode, carrying out selective sonic action on a formation and taking downhole samples at a bottom-hole pressure controlled with the jet pump, then stopping supplying the active medium, thus moving the bearing sleeve together with the insert in its upper position under the action of the spring and isolating the inner cavity of the pipe string from the annular space, and then extracting the insert together with the jet pump and the downhole instruments and equipment to the surface with the use of the cable or the wire.

The stated objective in respect of the method is solved and the technical effect is achieved due to that, after extracting the insert with the jet pump to the surface, an acid solution or a hydrofracturing liquid may be pumped into the under-packer space along the pipe string.

The stated objective in respect of the method is solved and the technical effect is achieved due to that, after extracting the insert with the jet pump to the surface, a flexible tube may be passed through the pipe string and the body to the well bottom for the purpose of cleaning it and the near-well area of the formation from propant, sand and other contaminants, after which a grouting mortar may be pumped to the well along the flexible tube for the purpose of carrying out water-insulation work or making cement bridging.

An analysis of the inventive well jet device after operation shows that work intensity of well studies may be improved by expanding a range of operations and studies that may be carried out in a well without lifting a well jet device to the surface. Making the body of the well jet device with a bearing sleeve that is spring-loaded against the body enables to close the bypass ports during carrying out some technological operations and, thus, separate the body inner cavity and space surrounding the body. When necessary, the insert with the jet pump may be removed from the bearing sleeve, and a flexible tube may be passed through the pipe string and the bearing sleeve of the well jet device for the purpose of flushing the well bottom or making a cement bridging. Thus, this operation may be carried out without lifting the pipe string to the surface, which sharply reduces time necessary for additional technological operations on studying and treating a producing formation. Also, an acid solution and/or a hydrofracturing fluid may be pumped through the pipe string and the bearing sleeve. Then, the insert with the jet pump may be returned to the mounting seat in the bearing sleeve for the purpose of continuing operations on studying, testing and repairing wells as well as for removing reaction products after treating a producing formation with chemical agents or removing a hydrofracturing fluid after its use for treatment of a producing formation. In the result, by operating the inventive well jet device it is possible to study wells in different modes, both before and after treatment of a producing formation.

In the result, the objective of the invention is achieved - technological capacities of a well jet device, which is used for conducting various studies of formations and carrying out other operations in wells, are expanded.

DESCRIPTION OF THE PREFERRED EMBODIMENT

Figure 1:
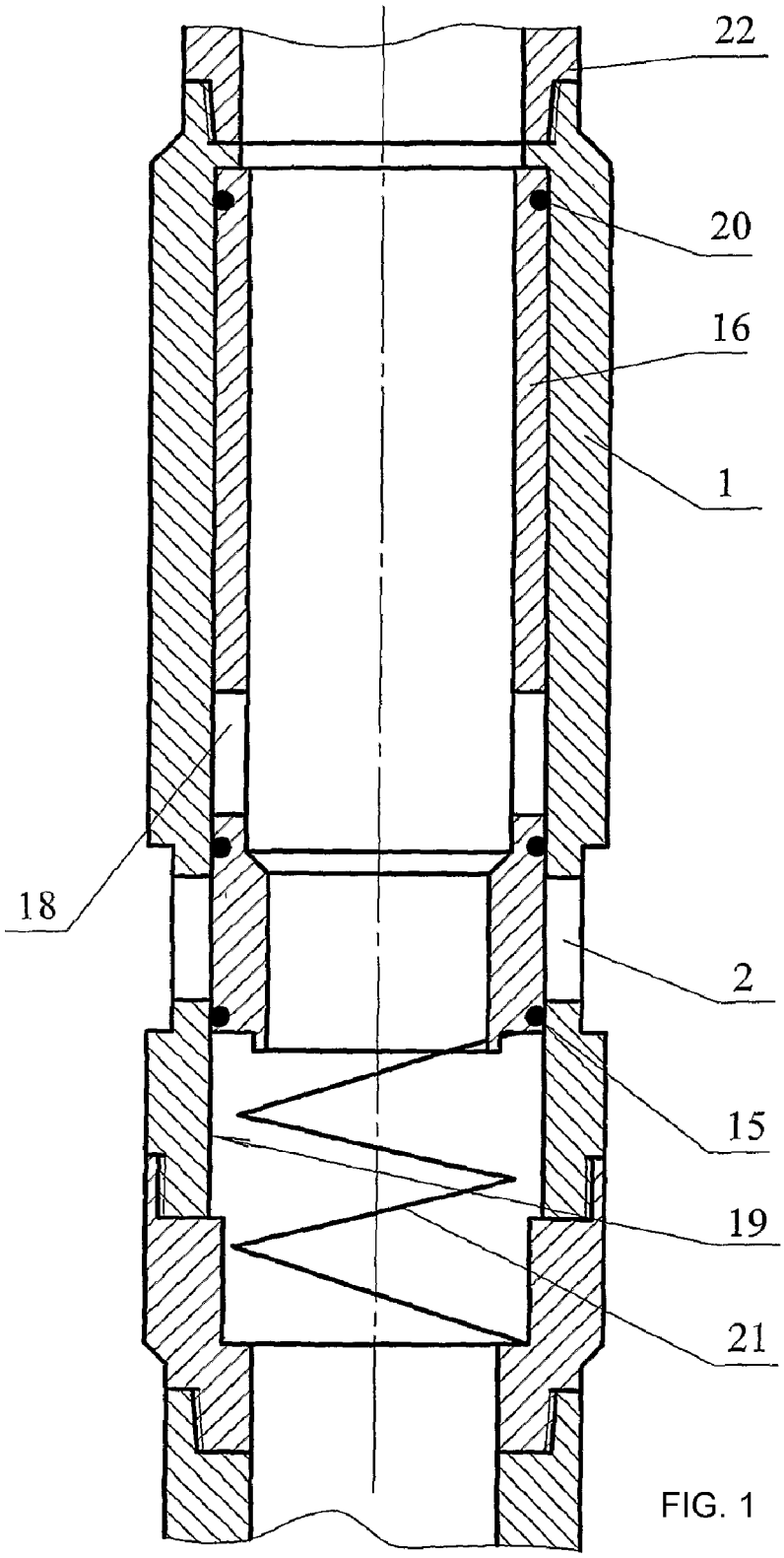
FIG. 1 shows a longitudinal section of the inventive device with a body and a bearing sleeve.
Figure 2:
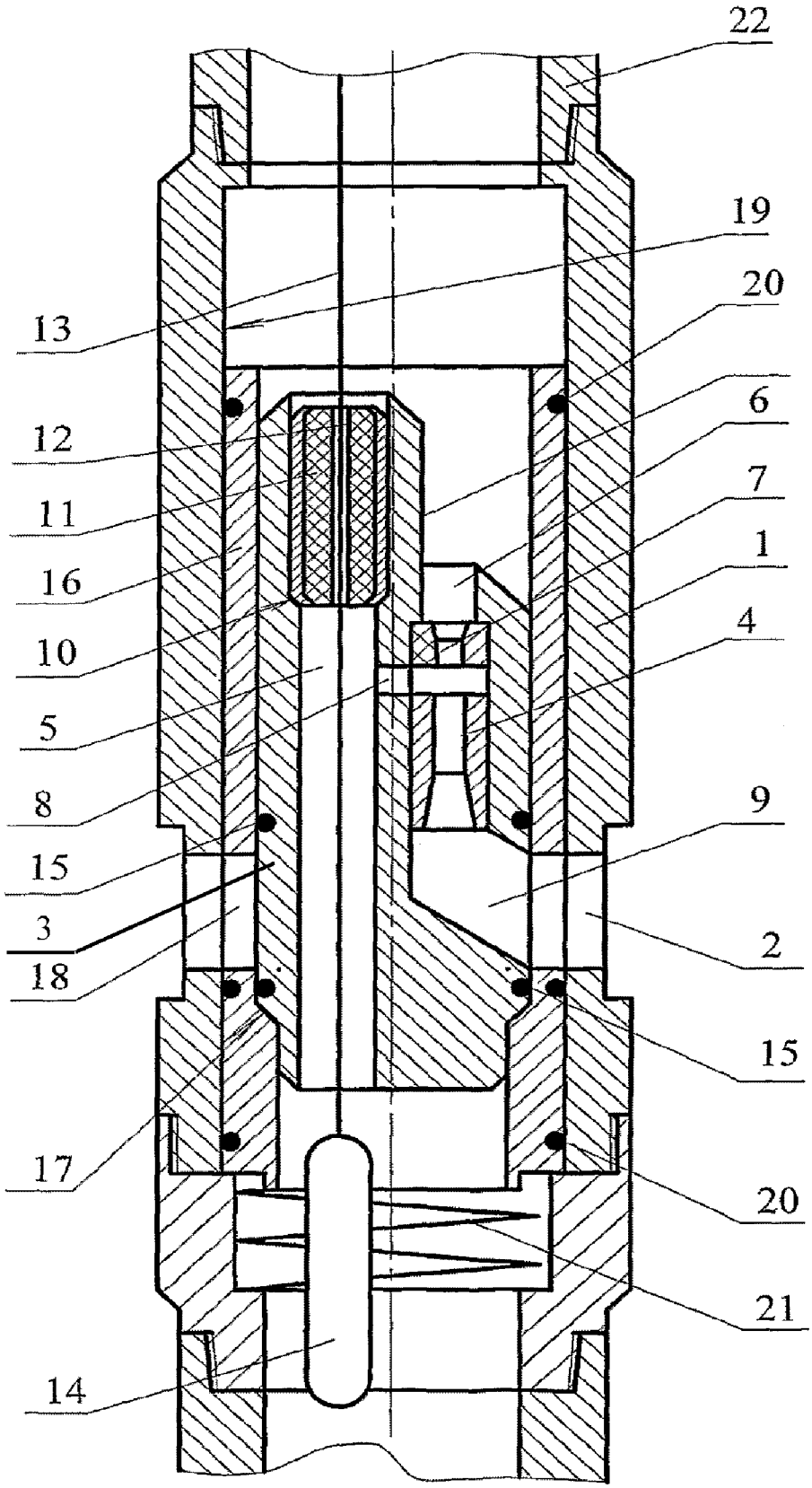
FIG. 2 shows a longitudinal section of the inventive device with an insert arranged in a bearing sleeve.
Figure 3:
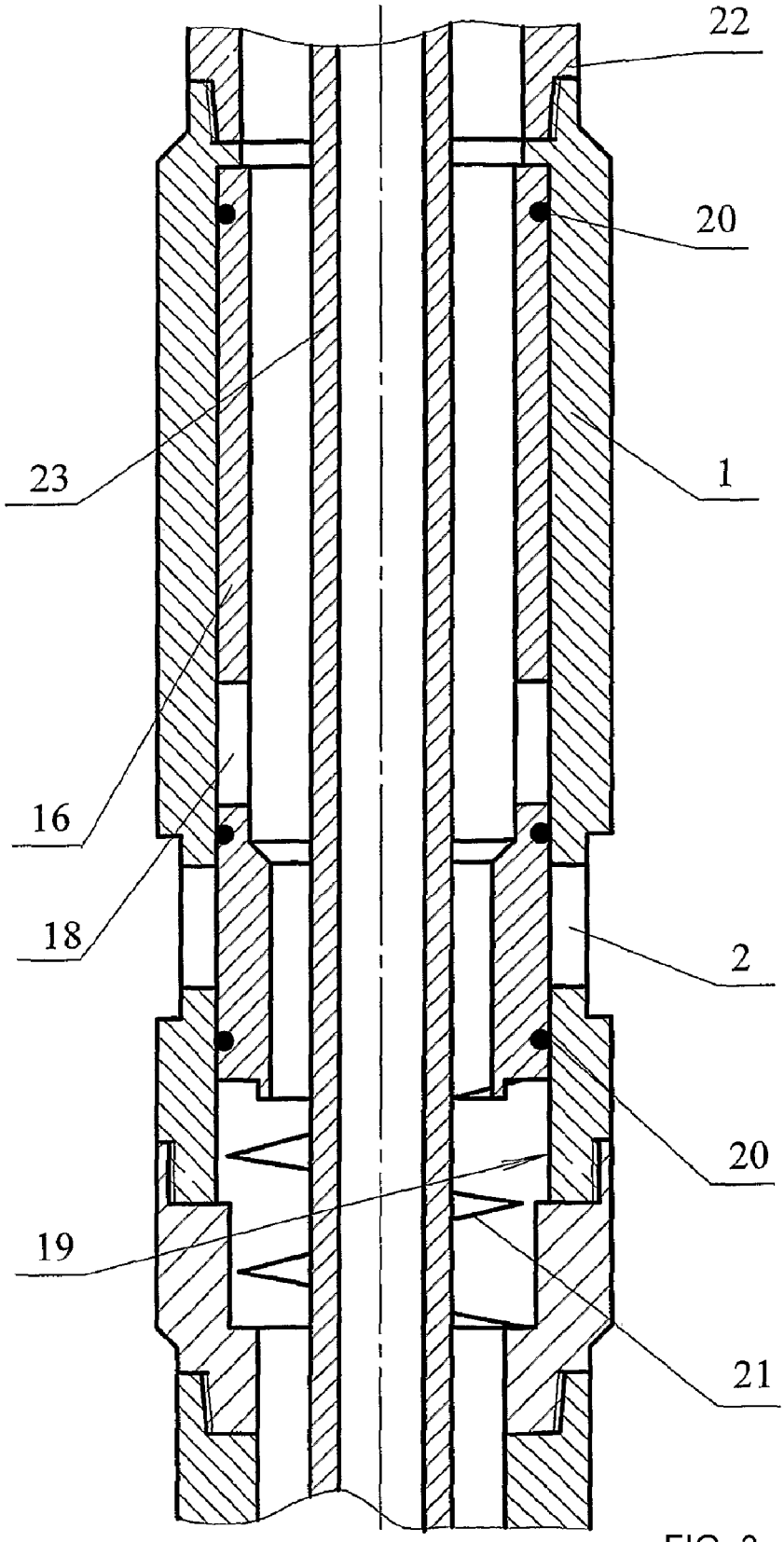
FIG. 3 shows a longitudinal section of the inventive device with an insert removed and a flexible tube passed through the pipe string and the body.

The inventive well jet device comprises a body 1 with bypass ports 2 and an insert 3 with a jet pump 4. A pass-through channel 5, a channel 6 for supplying an active medium to the nozzle 7 of the jet pump 4, a channel 8 for supplying a pumped-out medium to the jet pump 4, which is in communication with the pass-through channel 5, and an output channel 9 are all made in the insert 3. Above the channel 8 for supplying a pumped-out medium a mounting seat 10 is made in the pass-through channel 5, on which a sealing unit 11 is arranged, and an axial channel 12 is made in the latter with the possibility of passing through it and through the pass-through channel a cable or a wire for arranging downhole instruments and equipment on any of them below the jet pump 4 with the possibility of moving them along the wellbore when the jet pump 4 is or is not operated. The output channel 9 is in communication with the well annular space, and sealing elements 15 are installed on the insert 3. An axially movable bearing sleeve 16, which is spring-loaded against the body 1, is installed in the body 1, and the insert 3 with the jet pump 4 is installed on a mounting seat 17 made in the bearing sleeve 16, the bearing sleeve 16 being provided with bypass openings 18 made in its wall. An annular recess 19 is made in the body 1, which limits movements of the bearing sleeve 16 by its ends, when the bearing sleeve 16 is in its lower position the output channel 9 is in communication with space surrounding the body 1 through the bypass openings 18 and the bypass ports 2, and when the bearing sleeve 16 is in its upper position the bypass ports 2 of the body 1 are closed by the wall of the bearing sleeve 16.

Additional sealing elements 20 are installed on the bearing sleeve 16 надand under the bypass openings 18. The bearing sleeve 16 is spring-loaded by a spring 21.

The proposed method of operating the inventive well jet device may be described as follows.

The body 1 with the bypass ports 2 and the spring-loaded bearing sleeve 16, as installed in it and has the bypass openings 18, is lowered into a well, the bypass ports 2 of the body 1 being closed by the wall of the bearing sleeve 16 which is in its upper position under the action of the spring 21. The insert 3 with the jet pump 4 is lowered into the well on the cable or the wire 13, the cable or the wire 13 being preliminarily passed through the axial channel 12 of the sealing unit 11 as well as through the pass-through channel 5 of the insert 3. The sealing unit 11 is installed on the mounting seat 10 in the pass-through channel 5. Downhole instruments and equipment 14, e.g., a well logging device, are attached to the lower end of the cable or the wire 13, then the insert 3 with the jet pump 4 and the sealing unit 11 is installed on the mounting seat 17 of the bearing sleeve 16, and the downhole instruments and equipment 14 are arranged with the use of the cable or the wire 13 at a pre-defined depth below the body 1 in the well. Then, a pressurized active medium, e.g., water, a salty solution or oil, is supplied along the pipe string 22, thus moving the spring-loaded bearing sleeve 16 together with the insert 3 with the jet pump 4 to its lowermost position, aligning the bypass openings 18 of the sleeve 16 with the bypass ports 2 of the body 1, and the active medium is supplied through the channel 6 for supplying an active medium to the nozzle 7 of the jet pump 4, which medium, while exiting the nozzle 7, forms a stable jet causing pressure reduction first in the channel 8 for supplying a pumped-out medium and then also in the inner cavity of the pipe string 22 below the jet pump body, thus creating a pressure drawdown on a producing formation in the well and drawing a formation fluid, as pumped out of the well, into the jet pump 4. While pumping out a formation fluid, parameters of the pumped-out formation fluid and physical parameters of the producing formation along the well bore are monitored with the use of the downhole instruments and equipment 14 installed on the cable or the wire 13, as well as formations are perforated in the pressure drawdown mode, selective sonic action is exerted on a formation and downhole samples are taken at a bottom-hole pressure controlled with the jet pump 4.

Then, the active medium supply is stopped, thus moving the bearing sleeve 16 together with the insert 3 in its upper position under the action of the spring 21 and isolating the inner cavity of the pipe string 22 from the annular space, and then the insert 3 together with the jet pump 4 and the downhole instruments and equipment 14 is extracted to the surface with the use of the cable or the wire 13.

After extracting the insert 3 with the jet pump 4 to the surface, an acid solution or a hydrofracturing liquid may be pumped into the under-packer space of the well along the pipe string 22.

After extracting the insert 3 with the jet pump 4 to the surface, a flexible tube 23 may be passed through the pipe string 22 and the body 1 to the well bottom for the purpose of cleaning the well bottom and the near-well area of the formation from propant, sand and other contaminants, after which a grouting mortar may be pumped to the well along the flexible tube for the purpose of carrying out water-insulation work or making cement bridging.

INDUSTRIAL APPLICABILITY

This invention may be used in the oil-and-gas industry for testing wells after drilling or during their underground repairs for the purpose of intensifying hydrocarbon production rates or increasing intake capacities of injection wells.

The invention claimed is:

1. A well jet device comprising a body with bypass ports and an insert with a jet pump, the insert having a pass-through channel, a channel for supplying an active medium into the jet pump nozzle, a channel for supplying a pumped-out medium to the jet pump which is in communication with the pass-through channel, and an output channel, a mounting seat being made in the pass-through channel above the channel for supplying a pumped-out medium, a sealing unit being installed on the mounting seat, and an axial channel being made in the sealing unit for passing a cable or a wire through it and the pass-through channel for the purpose of installing on said cable or wire below the jet pump in a well downhole instruments and equipment with the possibility of moving them along the wellbore when the jet pump is or is not operated, the output channel being in communication with well annular space, and sealing elements are installed on the insert, characterized in that an axially movable bearing sleeve, which is spring-loaded against the body, is installed in the body, and an insert with a jet pump is arranged on a mounting seat made in the bearing sleeve, said bearing sleeve being provided with bypass openings made in its wall, an annular recess being made in the body, which limits by its ends movement of the bearing sleeve, and, when the bearing sleeve is in its lower position, the output channel is in communication through the bypass openings and the bypass ports, and, when the bearing sleeve is in its upper position, the body bypass ports are closed by the wall of the bearing sleeve.

2. A well jet device as claimed in claim 1, characterized in that additional sealing elements are installed on the bearing sleeve and under the bypass openings.

3. A method of operating a well jet device comprising lowering its body provided with bypass ports and with a spring-loaded bearing sleeve having bypass openings, the body bypass ports being closed by the wall of the bearing sleeve which is in its upper position under the action of the spring, lowering an insert with a jet pump on a cable or a wire into a well, said cable or wire being preliminarily passed through an axial channel of a sealing unit as well as through a pass-through channel of the insert, installing the sealing unit on a mounting seat in the pass-through channel, attaching downhole instruments and equipment, e.g., a well-logging instrument for registration of a formation fluid inflow profile, to the lower end of the cable or the wire, installing the insert together with the jet pump and the sealing unit on a mounting seat of the bearing sleeve, and arranging downhole instruments and equipment with the use of the cable or the wire at a pre-defined depth in the well below the body, supplying a pressurized active medium, e.g., water, a salt solution or oil, along the pipe string, thus moving the spring-loaded bearing sleeve together with the insert and the jet pump to a lowermost position for aligning the bearing sleeve bypass openings with the body bypass ports, and supplying an active medium through the channel for supplying an active medium to a jet pump nozzle, which medium, while exiting the nozzle, forms a stable jet causing pressure reduction first in a channel for supplying a pumped-out medium and then also in an inner cavity of the pipe string below the jet pump body, thus creating a pressure drawdown on a producing formation in the well and drawing a formation fluid, as pumped out of the well, into the jet pump, monitoring, while pumping out a formation fluid, parameters of the pumped-out formation fluid and physical parameters of the producing formation along the well bore with the use of the downhole instruments and equipment installed on the cable or the wire, as well as perforating formations in the pressure drawdown mode, carrying out selective sonic action on a formation and taking downhole samples at a bottom-hole pressure controlled with the jet pump, then stopping supplying the active medium, thus moving the bearing sleeve together with the insert in its upper position under the action of the spring and isolating the inner cavity of the pipe string from the annular space, and then extracting the insert together with the jet pump and the downhole instruments and equipment to the surface with the use of the cable or the wire.

4. A method as claimed in claim 3, characterized in that an acid solution or a hydrofracturing fluid is pumped into underpacker space of a well along a pipe string.

5. A method as claimed in claim 3, characterized in that a flexible tube may be passed through the pipe string and the body to the well bottom for the purpose of cleaning it and the near-well area of the formation from propant, sand and other contaminants, after which a grouting mortar may be pumped to the well along the flexible tube for the purpose of carrying out water-insulation work or making cement bridging.

* * * * *